US010186756B2

(12) United States Patent
Dalmia

(10) Patent No.: US 10,186,756 B2
(45) Date of Patent: Jan. 22, 2019

(54) ANTENNAS IN ELECTRONIC DEVICES

(71) Applicant: Intel IP Corporation, Santa Clara, CA (US)

(72) Inventor: Sidharth Dalmia, Fair Oaks, CA (US)

(73) Assignee: Intel IP Corporation, Santa Clara, CA (US)

( * ) Notice: Subject to any disclaimer, the term of this patent is extended or adjusted under 35 U.S.C. 154(b) by 147 days.

(21) Appl. No.: 15/225,527

(22) Filed: Aug. 1, 2016

(65) Prior Publication Data

US 2018/0034134 A1 Feb. 1, 2018

(51) Int. Cl.
*H01Q 1/24* (2006.01)
*H01Q 5/49* (2015.01)

(52) U.S. Cl.
CPC ..... *H01Q 1/243* (2013.01); *H01Q 5/49* (2015.01)

(58) Field of Classification Search
CPC ..... H01Q 1/243; H01Q 5/49
USPC ..... 343/702
See application file for complete search history.

(56) References Cited

U.S. PATENT DOCUMENTS 5,444,453 A 8/1995 Lalezari
8,686,905 B2 * 4/2014 Shtrom ..... H01Q 1/241 343/702
8,797,224 B2 * 8/2014 Shinkai ..... H01Q 3/44 343/818
8,896,487 B2 * 11/2014 Chiang ..... G06F 1/1616 343/700 MS
8,952,860 B2 * 2/2015 Li ..... H01Q 9/42 343/702
9,559,425 B2 * 1/2017 Zhu ..... G01V 3/00
9,583,838 B2 * 2/2017 Zhu ..... H01Q 13/10
9,728,858 B2 * 8/2017 Zhu ..... H01Q 13/10
2004/0051670 A1 3/2004 Sato
2008/0036675 A1 2/2008 Fujieda
2011/0012794 A1 1/2011 Schlub et al.
2014/0225787 A1 8/2014 Ramachandran et al.

OTHER PUBLICATIONS

International Search Report and Written Opinion for PCT Application No. PCT/US2017/045350, dated Nov. 15, 2017, 15 pages.

* cited by examiner

*Primary Examiner* — Huedung Mancuso
(74) *Attorney, Agent, or Firm* — Eversheds Sutherland (US) LLP

(57) ABSTRACT

In various embodiments, the disclosure describes systems and methods that can be use in connection with electronic devices (for example, mobile devices) and can include one or more a dies, first antenna elements/feeding elements electrically coupled to the die, and second antenna elements/parasitic elements disposed on at least a portion of the electronic device. In one embodiment, the parasitic elements can be disposed near the feeding element and in a spaced relationship over one or more gaps. Further the parasitic elements can be electrically coupled to the feeding element over the gap. In various embodiments, the disclosed systems and methods can be used to implement a Yagi-Uda antenna in an electronic device, for example, a mobile device.

19 Claims, 10 Drawing Sheets

ANTENNAS IN ELECTRONIC DEVICES

TECHNICAL FIELD

This disclosure generally relates to antennas in electronic devices (e.g., wireless devices).

BACKGROUND

Electronic devices such as mobile phones, base stations, and the like frequently make use of one or more antennas for wireless communication. As electronic devices continue to have smaller physical footprints, providing antennas that can transmit and receive information at requisite bandwidths becomes more challenging.

BRIEF DESCRIPTION OF THE FIGURES

Reference will now be made to the accompanying drawings, which are not necessarily drawn to scale, and wherein.

DETAILED DESCRIPTION

Figure 1:
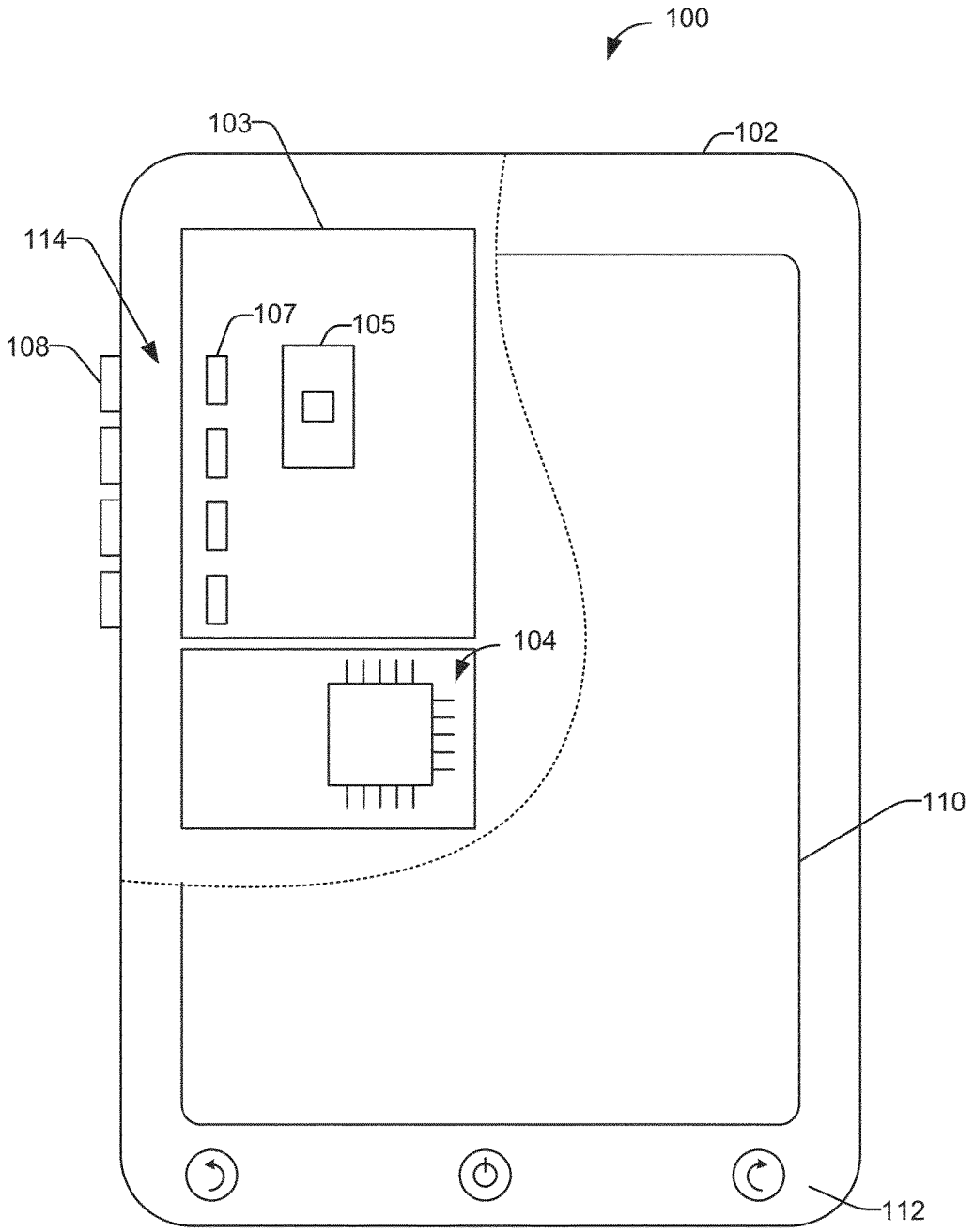
FIG. 1 depicts a simplified diagram depicting an example electronic device having various antennas elements, in accordance with example embodiments of the disclosure.

Embodiments of the disclosure are described more fully hereinafter with reference to the accompanying drawings, in which example embodiments of the disclosure are shown. This disclosure may, however, be embodied in many different forms and should not be construed as limited to the example embodiments set forth herein; rather, these embodiments are provided so that this disclosure will be thorough and complete, and will fully convey the scope of the disclosure to those skilled in the art. Like numbers refer to like, but not necessarily the same or identical, elements throughout.

The following embodiments are described in sufficient detail to enable at least those skilled in the art to understand and use the disclosure. It is to be understood that other embodiments would be evident based on the present disclosure and that process, mechanical, material, dimensional, process equipment, and parametric changes may be made without departing from the scope of the present disclosure.

In the following description, numerous specific details are given to provide a thorough understanding of various embodiments of the disclosure. However, it will be apparent that the disclosure may be practiced without these specific details. In order to avoid obscuring the present disclosure, some well-known system configurations and process steps may not be disclosed in full detail. Likewise, the drawings showing embodiments of the disclosure are semi-diagrammatic and not to scale and, particularly, some of the dimensions are for the clarity of presentation and may be exaggerated in the drawings. In addition, where multiple embodiments are disclosed and described as having some features in common, for clarity and ease of illustration, description, and comprehension thereof, similar and like features will ordinarily be described with like reference numerals even if the features are not identical.

The term "horizontal" as used herein may be defined as a direction parallel to a plane or surface (e.g., surface of a substrate), regardless of its orientation. The term "vertical," as used herein, may refer to a direction orthogonal to the horizontal direction as just described. Terms, such as "on," "above," "below," "bottom," "top," "side" (as in "sidewall"), "higher," "lower," "upper," "over," and "under," may be referenced with respect to the horizontal plane. The term "processing" as used herein includes deposition of material or photoresist, patterning, exposure, development, etching, cleaning, ablating, polishing, and/or removal of the material or photoresist as required in forming a described structure.

Current packaging substrate technology for various electronic devices used in wireless communications (for example, in millimeter wave communications such as 5G mobile networks operating at approximately 20 GHz to approximately 88 GHz, and WiGig wireless networks operating at approximately 60 GHz±5 GHz) may use homogenous multilayer substrates. For example, the packaging technology may use a Bismaleimide-Triazine (BT) laminate, FR4, polymer based or Low Temperature Co-fired Ceramics (LTCC) based substrate. Alternatively or additionally, the packaging substrate technology may use a package-on-package technology where one or more secondary packages carry the antennas. For example, one side of the substrate(s) (e.g., laminate and/or LTCC substrates) may house one or more dies (e.g., one or more Radio Frequency Integrated Circuits, also referred to herein as RFICs) which may further be surface mounted. Another side of the substrate(s) may house the antennas, which may be printed (e.g., using photolithography). However, such approaches can lead to increased fabrication costs, increased package size, e, large package volume, and/or decreased yields (for example, decreased yields of multilayer (e.g., greater than or equal to about 8 to 10 layers) substrates). Further, such approaches may additionally reduce design flexibility for the one or more antennas on the electronic devices, which may reduce performance for the antennas (e.g., in terms of antenna gain and/or directionality). Moreover, die (e.g., a RFIC) based routing (for example, including radiofrequency (RF) and/or signal integrity (SI) design) considerations can differ from the requirements of antennas, leading to increased fabrication complexity.

In various embodiments, the disclosure describes systems and methods for implementing antennas having one or more antenna elements (e.g., second antenna elements/director elements/parasitic elements) on or in the housing or a member thereof (e.g., a chassis component) of an electronic device, but not necessarily on the internal components (e.g., substrates, packages, and other portions) of the electronic device. In one embodiment, the feeding elements can be used to generate, send, and receive electromagnetic signals for the electronic device; further, the parasitic elements can direct the electromagnetic radiation generated by the feeding elements. In one embodiment, the feeding elements may be in communication with one or more packages of the electronic device via a wire trace or wire.

Positioning feeding elements and parasitic elements on the same die, substrate, and/or package (e.g., elements internal to the electronic device) can have limited performance enhancement to the antennas of the electronic device. This disclosure describes, in part, systems and methods for (1) removing the parasitic elements from the same die, substrate, and/or package and (2) placing the parasitic elements on the outer package (e.g., chassis or other structural features) associated with the electronic device in a spaced relationship with respect to the feeding elements.

In one embodiment, the feeding elements can be spaced from the parasitic elements over a gap. Further, having a space between the feeding elements and parasitic elements, for example, an air gap or a gap filled with any suitable material (gas, dielectric, liquid, etc.) can increase the performance of the electronic device while decreasing the thickness of the electronic components on substrates associated with the electronic device due at least to the requirement of fabricating fewer layers. The antennas can, in various embodiments of the disclosure, include Yagi-Uda antennas having one or more feeding elements and one or more parasitic elements, though it should be appreciated that the disclosure can be applied to other antenna designs, for example, antennas designs having two or more elements.

FIG. 1 illustrates a diagram of an example electronic device 100 having first antenna elements/feeding elements and second antenna elements/parasitic elements, in accordance with one or more example embodiments of the disclosure. In particular, FIG. 1 illustrates a partial cutaway view of the front of the electronic device 100 (for example, a tablet, smartphone, game device, music player, radio, etc.), exposing certain features of the electronics of the electronic device 100. As shown, the electronic device 100 may include structural components such as a housing member 102, which may also be referred to as housing 102. The housing member 102 can be formed from a rigid or semi-rigid material and, in some embodiments, can include one or more members (or components) that can permit supporting and/or enclosing functional elements of the electronic device 100. Such member(s) (or component(s)) also can be formed from a rigid or semi-rigid material. In one aspect, the housing member 102 can be mechanically coupled to the display device 110. In some embodiments, the housing member 102 can include or can be embodied in a chassis component. In some aspects, the chassis component can be formed from a rigid material or a semi-rigid material. In one example, the chassis component can be embodied in or can include a metal slab or a plastic slab. The housing member 102 may include or support a structural member or substrate 103 to which the electronics 104 and/or printed circuit boards (PCBs) may be attached, affixed, mounted, or the like. For example, the electronics 104 may include a semiconductor package 105, which may be affixed. The semiconductor package 105 may include one or more die, also referred to herein as chips, such as one or more radiofrequency integrated circuits (RFICs). The semiconductor package 105 can utilize an antenna 106 for sending and receiving wireless signals that, in certain embodiments, and can be further processed by various components of the electronics 104, which may include a processor or other types of computing components, a memory device or other types of storage devices, a combination of the foregoing, or the like.

The antenna 106 can, in various embodiments of the disclosure, include a Yagi-Uda antenna having one or more feeding elements 107 and one or more parasitic elements 108. Further, whether configured as a Yagi-Uda antenna or another antenna design, more or less antenna elements may be included. For instance, a Yagi-Uda antenna can also include one or more reflector or ground elements (not shown). It should be appreciated that the disclosure can be applied to other antenna designs, for example, antennas designs using two or more elements. In one embodiment, the feeding elements 107 can be used to send and receive electromagnetic signals e.g., by generating electromagnetic radiation; the parasitic elements 108 can direct and redirect the electromagnetic radiation generated by the feeding elements 107. In one embodiment, having the feeding elements 107 spaced from the parasitic elements 108 can provide enhanced performance by the antenna assembly including the feeding elements and the parasitic elements.

The feeding elements 107 may be in communication with a package (e.g., a semiconductor package) 105 via a wire trace or wire, and the parasitic elements may be in a spaced relationship with the feeding elements and may be wirelessly coupled to the feeding elements 107. Further, having a gap between the feeding elements 107 and parasitic elements 108, for example, an air gap or a gap filled with any suitable material (gas, dielectric, liquid, etc.) can increase the signal reception and transmission performance of the electronic device while decreasing the thickness of the electronic components on the substrate due at least to the requirement of fabricating fewer fabricated layers.

As shown further in FIG. 1, the feeding elements 107 can be distributed in a regular (e.g., periodic, and/or equally distributed) array on the substrate 103 on the package 105. In alternative embodiments, the feeding elements 107 may be arranged in any other suitable pattern (e.g., not periodic, circular, etc.). Additionally or alternatively, the feeding elements 107 may be affixed onto, proximate to, and/or form a feature of a substrate 103 and/or integrated into the package 105, for example, in the form of one or more vias and/or metal traces that comprise the die associated with the package 105. Additionally or alternatively, the feeding elements 107 may be formed on or integral to a component or feature of the substrate 103 and/or the electronic 104, such as one or more vias, metal traces, metal lines, and the like.

FIG. 1 further illustrates one or more parasitic antenna elements 108, which can be a passive or parasitic element of an antenna, placed on or in proximity to the housing member 102 of the electronic device 100. In some embodiments, the one or more director antenna elements 108, or the parasitic element of the antenna, can be place on in proximity to a chassis component included in or constituting the housing member 102. The parasitic elements 108 can, in some embodiments, be positioned in a spatially predetermined way with the feeding elements 107. In one example embodiment, the parasitic elements 108 can partially overlap the feeding elements 107 over a gap, for example, an air gap (to be discussed further below).

In other embodiments, the parasitic elements 108 can be formed and/or placed on any portion of the electronic device 100 including, but not limited to, on one or more of the sides and/or the top/bottom surfaces, an interior surface, an exterior surface, embedded in a surface, or any combination thereof. Additionally or in other embodiments, the parasitic elements 108 can be formed on or as a part of one or more design features and/or indicia on the housing member 102 or a chassis component included in the housing member 102. For example, the parasitic elements 108 can be a part of a logo imprinted and/or stamped on or into the housing member 102 or the chassis component. In addition or in another example, the parasitic elements 108 can be placed in any suitable fashion on or proximate to the first portion of the electronic device 100, such as in a defined portion of the housing member 102 or the chassis component included in the housing member 102.

FIG. 1 further illustrates a display device 110 associated with the electronic device 100. The display device 110 can include a light-emitting diode (LED), an organic light-emitting diode (OLED) and/or any other suitable lighting sources. The display device 110 also can include imaging elements, which can be coupled to optical elements (such as filters, lenses, and the like) the can permit the emission of light from the lighting source in accordance with an image formed. In some implementations, the imaging elements can be pixelated and can be embodied in discrete semiconductor devices. The display device 110 also can include a screen member formed from glass or plastic, for example. Each of the glass or the plastic can be either transparent or translucent. In some embodiments, the screen member can be functionally coupled (e.g., electrically coupled and/or mechanically coupled) to a device or circuitry that can render the screen member sensitive to pressure (e.g., a touch, a swipe, or the like). Though not explicitly shown in FIG. 1, the electronic device 100 may additionally comprise a reflector, of which at least a portion of the reflector may be positioned substantially proximate to the display device 110 or a portion thereof (e.g., behind the display device 110 from the view of the electronic device 100 shown in FIG. 1). In some embodiments, the reflector may include an electromagnetic interface (EMI) shield. The EMI shield can reflect electromagnetic radiation, for example, the electromagnetic radiation produced by the feeding elements 106 and/or the parasitic elements 108.

FIG. 1 additionally illustrates a case 112 on the electronic device 100. In one or more embodiments, the electronic device 100 can be protected from impact forces and environmental elements by the case 112 and/or be visually enhanced by decorative cases 112 or any other suitable case 112. In one embodiment, the parasitic elements 108 may be formed in, on, be attached to, or be proximate to the case 112. Although not shown in FIG. 1, the parasitic elements 108 can be formed in, on, be a part of, be attached to, or be proximate to a peripheral and/or a mechanically-disconnectable component associated with the electronic device 100 including, but not limited to, a portion of a power cord connector and/or any other peripheral device. For example, the power cord connector may or may not be electrically coupled to the electronic device 100 by a connector that can provide for alignment of the parasitic elements 108 of the connector to the feeding elements 108 when the connector is coupled to the electronic device 100.

FIG. 1 illustrates an electronic device 100 that may be a tablet as discussed above; however, the electronic device 100 can be any suitable device having radio transmission capability, including, but not limited to, a mobile device (smart phone/cell phone), a wireless access point (WAP), a base station, a walkie-talkie, a radio transceiver, a gaming console, a remote control and/or any other suitable electronic device.

The feeding elements 107 and/or the parasitic elements 108, in certain embodiments can be separated by a gap 114, which may include one or more of air, an inert gas, a liquid, a dielectric and the like. The gap 114 may provide enhanced antenna performance (e.g., antenna gain, directionality, etc.) because air can serve as a better medium of transmission of electromagnetic radiation (as compared with, for example, dielectric materials). Also, by using the area associated with the housing member 102 (or, in some embodiments, a chassis component included in the housing member 102) to increase the distance between feeding elements 107 and the parasitic elements 108 and/or by increasing the area of the feeding elements 107 and/or the parasitic elements 108 may provide enhanced antenna performance (e.g., antenna gain, directionality, etc.).

Figure 2A:
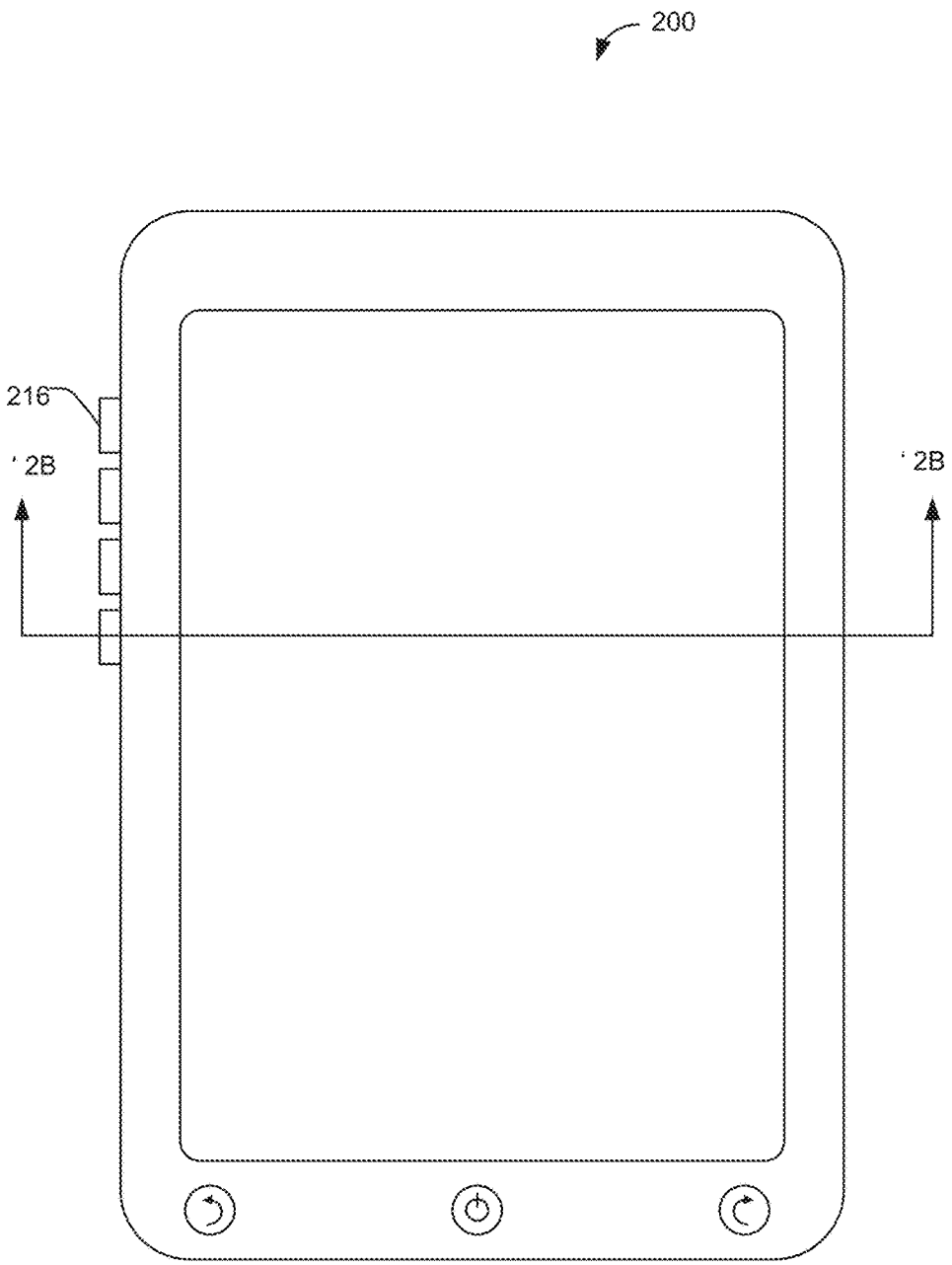
FIG. 2A depicts a simplified diagram depicting a view of an example electronic device, in accordance with example embodiments of the disclosure.

FIG. 2A illustrates a electronic device 200, in accordance with example embodiments of the disclosure. In particular, FIG. 2A depicts the electronic device 200, which may be a cell phone, tablet, gaming device, laptop, base station, a wireless access point (WAP), etc., having antenna parasitic elements 216 exposed at the exterior of the electronic device 200. For example, the parasitic elements 216 may be mounted on and/or in the exterior surface of the electronic device 200, and are configured to interact with feeding elements of the electronic device 200, as discussed below. In one embodiment, there may not be need for cabling between the parasitic elements 216 and the one or more dies 206, and/or any other electronic component (for example, including, but not limited to, electric components 210). Further, FIG. 2A provides a cross-sectional line of view '2B-'2B, which is illustrated in FIG. 2B.

Figure 2B:
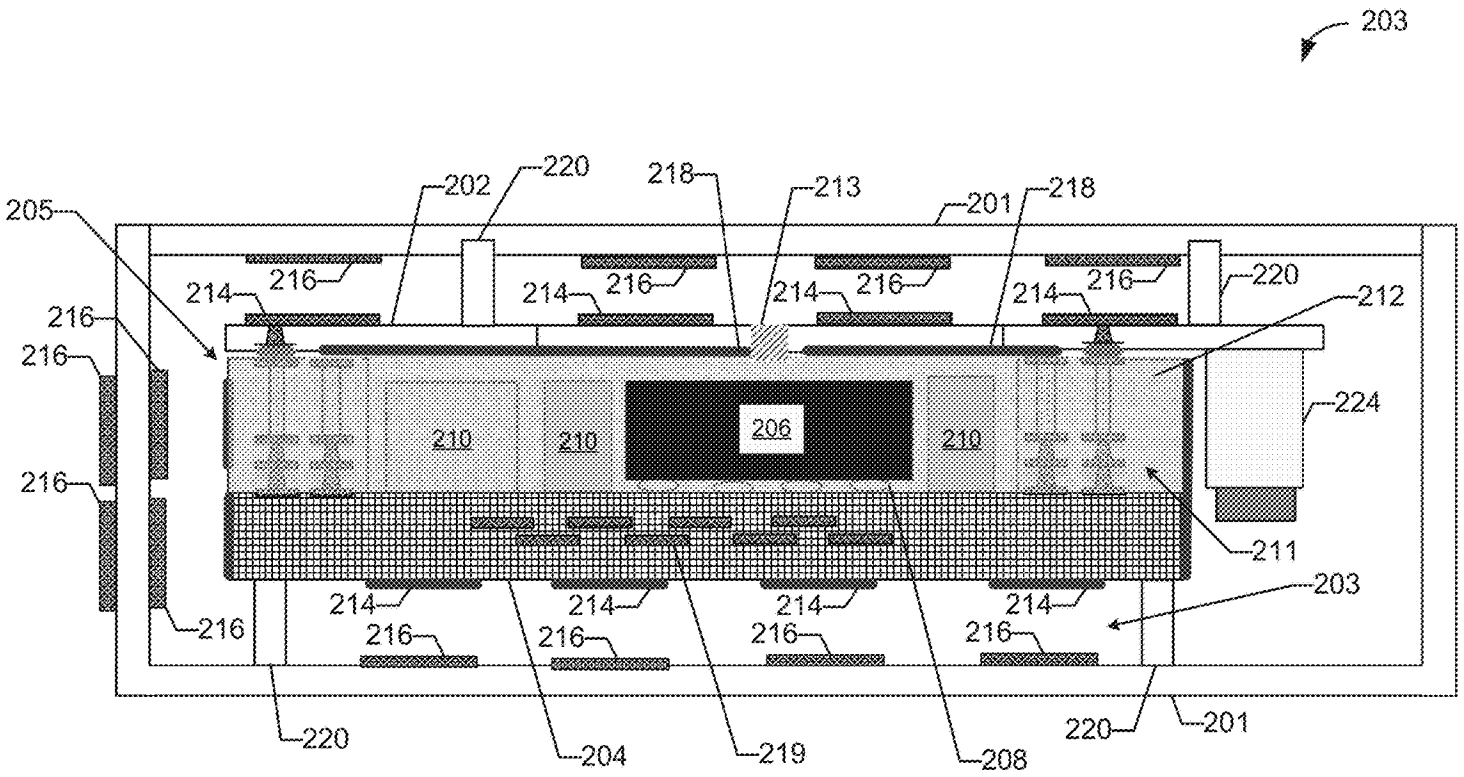
FIG. 2B depicts a simplified diagram depicting a cross-sectional view (as indicated in FIG. 2A) of a portion of an example electronic device having various antennas elements, in accordance with example embodiments of the disclosure.

FIG. 2B provides a cross-sectional view '2B-'2B of the electronic device 200, in accordance with an example embodiment of the disclosure. In the embodiment of FIG. 2B, shown is an example implementation of a Yagi-Uda antenna. The Yagi-Uda antenna implementation, as shown in FIG. 2B, can include one or more packages 205 (for example, a semiconductor package and/or an antenna package, as discussed above), one or more feeding elements 214, one or more reflector elements 218, one or more grounding elements 219, and one or more parasitic elements 216, in accordance with common definitions of a Yagi-Uda antenna. The embodiments of this disclosure may be applied to other antenna designs (e.g., other than Yagi Uda, and name a few such antenna designs such as microstrip antennas, phased array antennas, planar array antennas, dual-band blade antennas, and the like.

In certain embodiments, the various elements of the electronic device 200, some of which are illustrated in FIG. 2, including, but not limited to, the feeding elements 214, the parasitic elements 216, the reflectors 218, the dies 206, and so on, can be mechanically coupled to one or more surfaces (e.g., the surface of a first portion of the electronic device/housing/chassis, a substrate, and PCB, etc.) by an epoxy material, and/or an underfill material. Representative epoxy materials may include an amine epoxy, imidizole epoxy, a phenolic epoxy or an anhydride epoxy. Other examples of epoxy underfill material include polyimide, benzocyclobutene (BCB), a bismalleimide type underfill, a polybenzoxazine (PBO) underfill, or a polynorborene underfill. Additionally, the underfill epoxy may include one or more suitable filler materials, such as silica. In example embodiments, the underfill epoxy may have fillers and/or other materials therein to preferentially control the coefficient of thermal expansion (CTE), reduce stresses, impart flame retardant properties, promote adhesion, and/or reduce moisture uptake in the underfill epoxy. Additives and/or chemical agents may be included in the underfill epoxy for desirable properties, such as a preferred range of viscosity, a preferred range of tackiness, a preferred range of hydrophobicity (e.g., surface wetting), a preferred range on particle suspension properties, a preferred range of cure temperatures, combinations thereof, or the like.

In one embodiment, the parasitic elements 216 can serve to modify the electromagnetic radiation produced by the feeding elements 214, and/or redirect and/or produce a predetermined beamform. This may, in various embodiments, lead to enhanced antenna performance (for example, enhanced gain and/or directivity) which can lead to enhanced performance of the electronic device. In an embodiment, not shown in the figure, the feeding elements can be proximate to the dies 206 and/or can be embedded within the die/chips 206.

In one embodiment, these antenna elements (e.g., feeding elements 214 and/or the parasitic elements 216) elements can have different relative sizes. Further, the feeding elements 214 can have a surface one or more mount feed points for integration into one or more substrates.

In another embodiment, the parasitic elements 216 can be placed at least partially inside a housing and/or a chassis component 201 (which also may be referred to as chassis 201). Alternatively or additionally, the one or more parasitic elements 216 can be placed at least partially outside the chassis 201 associated with an electronic device. In one embodiment, the parasitic elements 216 can be at least partially a part of an aesthetic feature of the electronic device 200, such as a design (for example, a logo).

In the illustrative embodiment of FIG. 2B, the package 205 (for example, a semiconductor package and/or an antenna package, as discussed above) can be proximate to, and/or attached to, and/or affixed to a substrate 202. The package 205 may include one or more dies 206, one or more electronic components/elements 210, one or more reflectors 218, or more feeding elements 214, one or more redistribution layers (RDLs) 212, one or more alignment elements 220 and/or one or more connectors 224 that may be fabricated on a core 204. The core 204 may comprise any suitable material, including but not limited to, organic material, inorganic material, silicon-based material, polymer material, and/or any other suitable material. The package can further include one or more die 206, also referred to herein as chips 206, which may include a radiofrequency integrated circuit (RFIC). The die 206 can be connected to various elements through interconnects 208, including but not limited to, a ball grid array (BGA). The die 206 can also be proximate to electronic components 210, including but not limited to capacitors, inductors, resistors, memory blocks, application specific integrated circuits (ASIC), and/or any other suitable electronic devices that may also be placed on or fabricated on, or proximate to the core 204. Further, inside and/or proximate to the core 204 may be grounding elements 219, which may provide electric ground to the die 206 and/or the electronic components 210. In one embodiment, the grounding elements 219 can comprise metallic layers, intermetallic layers, semi-metallic layers, or any other suitable material layer. Non-limiting examples of metallic layer include layers including gold, copper, silver, aluminum, zinc, tin, platinum, and any of the like. Metallic materials may also be any alloys of such materials. Non-limiting examples of intermetallic layers include layers including include gold and aluminum intermetallics, copper and tin intermetallics, tin and nickel intermetallics, tin and silver intermetallics, tin and zinc intermetallics, and any of the like. Intermetallic materials may also be any alloys of such materials. Non-limiting examples semi-metallic layer include layers including include arsenic, antimony, bismuth, α-tin (gray tin) and graphite, and mercury telluride (HgTe). Semi-metallic materials may also be any mixtures of such materials.

The dies 206 and/or the electronic elements 210 can be connected to the feeding elements 214 through redistribution dielectric layers (RDLs) 211 that can optionally include, but not be limited to, interconnecting layers, through vias, buildup (BU) layers and/or metal layers.

FIG. 2B further illustrates one or more reflectors 218 can be formed on, near and/or proximate to the substrate 202, which can, in various embodiments, be used to reflect electromagnetic radiation, for example, electromagnetic radiation produced and/or transmitted by the feeding elements 214. In one example embodiment, the reflector 218 can include a metallic and/or an intermetallic and/or a semi-metallic material, including but not limited to a silver layer, a copper layer, a gold layer, and the like. In various embodiments, the reflectors can be an optional element of the design. For instance, other antenna designs (e.g., microstrip antennas, phased array antennas, planar array antennas, dual-band blade antennas, and the like) may not include this element.

Further, in various embodiments, the die 206 and/or the electrical components 210 and/or the redistribution layers 211 can be encapsulated partially or fully by at least a portion of an overmold/molding layer 212. In one embodiment, the molding material can provide environmental protection for the die 206 and/or the electronic elements 210 and/or the RDLs 211. In various embodiments the molding layer may comprise any suitable material, such as a polymer, an organic compound, and the like.

In one embodiment, a thermal grease material 213 may further encapsulate and/or provide environmental protection and/or provide thermal dissipation capability to the die 206, the electrical elements 210, and/or RDLs 211. The thermal grease may be of any suitable type, such as epoxies, silicones, urethanes, acrylates, solvents, combinations thereof, or the like. The thermal grease may further have any suitable fillers therein, such as silver, aluminum oxide, zinc oxide, aluminum nitride, combinations thereof, or the like. The thermal grease may have any suitable properties, such as any variety of thermal conductivity to conduct thermal energy from electrical components, electrical insulation to prevent unwanted leakage current, viscosity and/or thixotropic properties suitable for injection of the thermal grease.

In one or more example embodiments, the feeding elements 214 can be placed periodically or in any pattern proximate to the substrate, the RDL 211, the core layer 204, and/or any other portion of the package.

In one embodiment, the grounding layer(s) 219 can be implemented as layers and can be implemented partially or fully by a single continuous layer in the core 204.

In one embodiment, the substrate 202 can be electronically connected to a connector 224 which can send and receive electrical signals to and from the die 206, the electronic elements 210, and/or the feeding elements 214. In various embodiments, the connector 224 can comprise any suitable connector including, but not limited to, a coaxial connector, an AFL connector, an electronic bus, a USB connector, an RF connector, or any other suitable connector. In one embodiment, the feeding elements 214 may be connected to the die 206 and can be disposed on the same substrate 202 and/or package 205. The parasitic elements 216, on the other hand, may not be on the substrate 202 and/or package 205, as they may be disposed on chassis 201 and/or other structural member of the outer package (not shown).

FIG. 2B further illustrates a portion of the electronic device 200, including a chassis 201. The chassis 201 can partially or fully enclose the package(s) 205, including the dies 206, the electronic components 210, and/or the feeding elements 214. The chassis 201 may include structural components as well as functional components. For example, the chassis 201 can include a frame, which can also be referred to as a tray or case of the device, to which various components may be attached or mounted, including a display, one or more semiconductor and/or antenna packages, electronic components, PCB's, spacers, mountings, connectors and ports for establishing physical connections with other devices (e.g., other phones, wireless connection points, laptops, and the like).

FIG. 2B further illustrates parasitic elements 216, which can be passive elements, parasitic antenna elements, mounted and/or attached to the chassis 201. The parasitic elements 216 may be positioned proximate to the chassis 201 such that there is a spatial overlap between the parasitic elements 216 and corresponding feeding element 214. This overlap can define a gap 203. The gap 203 enables a degree of wireless electromagnetic coupling (for example, capacitive coupling) between the feeding elements 214 and the parasitic elements 216 (e.g., without a direct trace or a wired connection). In one embodiment, the package 205 can be positioned inside the portion of the chassis 201 over a gap 203 (additionally or alternatively referred to as an air gap, void, separation area, and/or a separation volume herein). The gap 203 can be filled with any suitable material, including, but not limited to air, nitrogen, helium, an inert gas, nitrogen, hydrogen, helium, any inert gas, xenon, argon, thermal grease, dielectric material, molding material, encapsulating material, desiccant material, and the like.

In an embodiment, the parasitic elements 216 can be positioned inside the chassis 201 and/or on the outside of the chassis 201. Additionally or alternatively, some of the parasitic elements 216 may be positioned inside or integral the chassis 201 while other parasitic elements 216 may be positioned outside the chassis 201.

In an example embodiment, the chassis 201 can at least partially or in full be supported and/or connected to a substrate 202 by alignment elements 220. In some embodiments, the alignment elements 220 can serve to spatially align with precision the parasitic elements 216 with the feeding elements 214, for example, to increase the degree of electromagnetic coupling between the feeding elements 214 and the parasitic elements 216 (as per the discussion above).

In an example embodiment, the alignment elements 220 can include a smart connector and/or a magnetic alignment element (to be discussed further below, see for example FIG. 6 and related discussion).

In one embodiment, not shown in FIG. 2B, portions of the die 206 can include feeding elements embedded within the die 206. For example, vias embedded in the layers forming the die 206 and/or any other feature of the dies 206 may form the feeding elements 214. Additionally, or alternatively, though not shown in FIG. 2B, the electronic components 210 can include feeding elements that can radiate electromagnetic radiation. In another embodiment not shown in FIG. 2B, any portion of the package, including but not limited to the RDL 210, can have features and/or components which may serve as feeding elements, including but not limited to, vias, o metal/trace layers and/or interconnects.

In one embodiment, the parasitic elements 216 may have a dimension of approximately 2 mm×2 mm, which may be proximate to the outside surface of the mobile device 200 (for example, mounted on or embedded in the chassis 201) and not be easily visible to the naked human eye. In one embodiment, the parasitic elements 216 can be dot-shaped elements (or four lines for the case of dipole antenna elements) mounted to or embedded in the chassis 201. In one embodiment, there may be a predetermined upper limit for the number of parasitic elements 216 that are utilized with the electronic device 200. This upper limit may reflect the point of saturation in the performance gains (e.g., increased directivity and/or gain) associated with the parasitic elements 216. In one embodiment, the upper limit may be 4 or 5 parasitic elements 216. In various embodiments the number of parasitic elements can be dependent on several factors, including, but not limited to the size and/or geometry of parasitic elements 216, the size and/or geometry of feeding elements 214, the frequency of operation, and the like.

In one embodiment, in an antenna assembly comprising feeding elements 214, parasitic elements 216, and/or reflector element(s) 218, the reflector elements 218 can be the largest element. The feeding elements 214 can be the second largest element associated with the antenna assembly. In another embodiment, the parasitic elements 216, can be the smallest element of antenna assembly.

In one embodiment, the parasitic elements 216 can include millimeter-wave antennas for use in connection with millimeter-wave applications. As such, millimeter wave can mean that the wavelength of application may be, for example, approximately 1 mm to approximately 5 mm. The wavelength of operation (that is, lambda divided by 4) can correspond to the dimensions of the antenna element (for example, the feeding elements 214 and/or the parasitic elements 216). Further, in various embodiments, arrays (for example, a 2×4, a 1×4, 4×4 and 8×8 and 16×16, 32×32, 64×64, 128×128, any combination thereof, or any other suitable array having any number of antenna elements) can be formed with the parasitic elements 216 (and/or the corresponding feeding elements 214).

In one embodiment, the feeding elements 214 can be implemented as surface mount (SMT) components. The feeding elements 214 may not be inside a package (for example, the package 205 of FIG. 2B). Rather, the feeding elements 214 can take the form of any SMT component. Additionally, various pieces of the electronic device 203 can operate as feeding elements. For example, a screw used in assembly of the mobile device, such as one to secure one or more of the PCBs and/or substrate 202 of the electronic device can be used as the feeding elements. Alternatively or additionally, the feeding element may be a part of a semiconductor package and/or a SMT component, such as a screw, a needle, and/or a pin of said components. In one embodiment, the screw can be metallic (e.g., gold and/or silver plated) which can act, for example, as a monopole antenna (or, depending on the geometry, as a dipole antenna, a patch antenna, a planar inverted f (PIFA) antenna, fractal antenna etc.) at the frequency/wavelength of operation (for example, for millimeter-wave antenna applications). In one embodiment, the screw acting as a monopole antenna can then correspondingly send/receive electromagnetic radiation to another element on the chassis 201 (e.g., parasitic elements 216). The resulting configuration of the feeding elements 214 and parasitic elements 216 (and/or reflector and/or grounding elements) can then act like a Yagi-Uda antenna, in an example embodiment, though other antenna designs may be achieved utilizing similar antenna elements according to the disclosure.

In one embodiment, the feeding elements 214 and/or parasitic elements 216 can have an associated dimension that can be a fraction of wavelength of the radiation emitted by the feeding elements 214 and/or parasitic elements 216.

In one embodiment, the gap 203 can be filled with a low-dielectric constant material (e.g., a dielectric constant close to approximately 1). This may result in improved performance (e.g., the in terms of directivity and/or gain) of the antenna assembly. In one embodiment, the loss tangent of the material partially or fully filling the gap 203 may be low (e.g., close to zero), which may result in improved performance (e.g., the in terms of directivity and/or gain) of the antenna assembly. However, it should be understood that the disclosure is not limited to embodiments of low dielectric constant and/or low-loss material (e.g., higher loss material can be used to at least partially fill the gap 203).

In one embodiment, a moisture-sensitive material (not shown) can be placed in the chassis 201, for example, in the gap 203. The moisture-sensitive material can be used to detect the presence of moisture inside the electronic device (for example, using Integrated circuits (ICs) electronically connected and at least partially controlling the moisture-sensitive material). In one embodiment, the detection of moisture inside the electronic device may indicate that the antennas (e.g., feeding elements 214 and/or parasitic elements 216) may have become misaligned.

As described herein, the arrangement of the feeding elements and parasitic elements may vary based on numerous factors. FIGS. 3-6 illustrates several examples of such an arrangement in accordance with embodiments of the disclosure.

Figure 3:
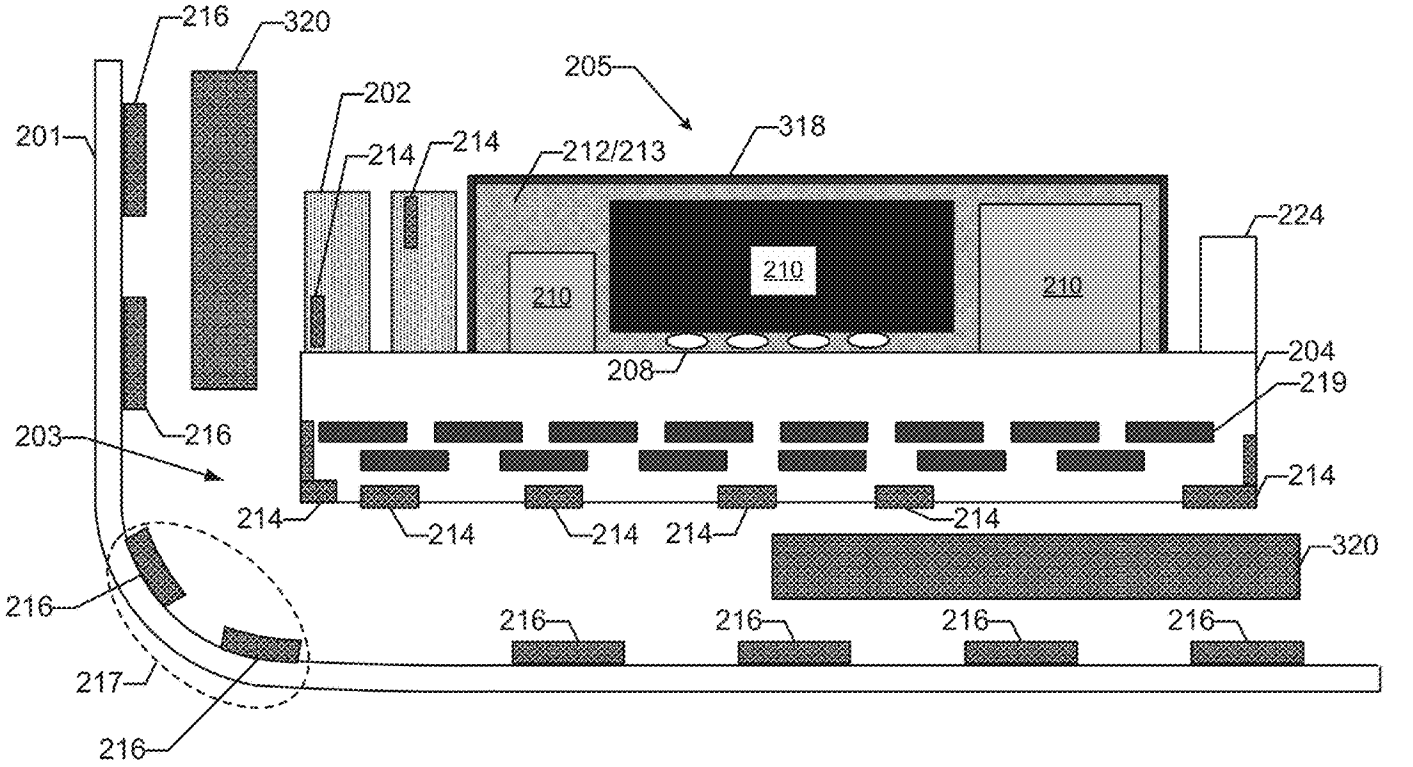
FIG. 3 depicts another simplified diagram depicting a cross-sectional view of a portion of an example electronic device having various antennas elements, in accordance with example embodiments of the disclosure.

FIG. 3 illustrates a simplified cross-sectional view of a portion 300 of an electronic device having the antenna package with feeding elements and parasitic elements in accordance with the disclosure. The portion 300 includes a core 204 on which die 206 can be attached, affixed to, and/or mechanically coupled. The core 204 may comprise any suitable material, including but not limited to, organic material, inorganic material, silicon-based material, polymer material, and/or any other suitable material. The die 206 can include, but is not be limited to, radiofrequency integrated circuits (RFICs).

FIG. 3 also illustrates electronic elements 210, similar to but not necessarily identical to the electronic elements 210 of FIG. 2B. The dies 206 can be connected to various elements through interconnects 208, for example substrates that may include feeding elements 214. FIG. 3 additionally illustrates that the first feeding elements 214 can be disposed on one or more substrates, which may or may not be contiguous to, proximate to, and/or electrically or mechanically coupled to the package 205. Further, while a RDL layer is not shown, RDL(s) may be included.

Also shown in FIG. 3 is the reflector and/or grounding layer(s) 212, which can, in some embodiments, be embedded within the core 204. If the reflector and/or grounding layer(s) 212 are used as reflector elements 212, the reflector elements 212 can serve to reflect electromagnetic radiation in various directions (for example, in a direction away from the feeding elements 214 and/or parasitic elements 216). Additionally or alternatively, the grounding elements 212 can provide electronic ground to circuits inside or associated with or comprising the die 206. Further, the parasitic elements 214 can be proximate to or mechanically and/or electronically coupled to the core 204.

Further, as shown in FIG. 3 the parasitic elements 216 can be disposed proximate to and/or affixed to a portion of the chassis 201. In particular, as shown in FIG. 3, the portion of the electronic device can be at least partially non-planar and/or curved and/or may assume a non-planar shape, as shown in area 217 of chassis 201, and parasitic elements 216 can be nevertheless be formed and/or affixed thereon (or therein). In certain embodiments, the parasitic elements 216 may have a non-planar shape which may confirm in part or whole with the chassis 201 or to the feature of the chassis to which the parasitic elements are formed or affixed. Such a feature of the chassis 201 may include a spacer, a support, a battery a power connector, a case, a frame, and the like.

A gap 203 (additionally or alternatively referred to as an air gap/a void/a separation area or volume) that may be defined by the chassis and/or components contained therein, such as a package, PCB, substrate, etc. For example, the gap 203, or a portion thereof, may be at least partially defined by the parasitic elements 216 and the feeding elements 214. Further, gap elements 320 can be positioned within the gap 203. In one embodiment, gap elements 320 can include sensors. The sensors can serve to detect misalignment between the feeding elements 214 and the parasitic elements 216. Additionally or alternatively, the gap elements 320 can serve to detect moisture present in the gap 203, for example, moisture resulting from exposure of the electronic device, which may leak into the device as a result of environmental exposure. In one embodiment, the sensors can include piezoelectric material, hydroscopic material, or any other suitable material for the detection of the moisture. In one embodiment, when the device is opened or taken apart it can be determined if the device was exposed to moisture in addition to the extent of that exposure, which may be valuable in diagnosing an issue.

Further, in certain embodiments, the gap 203 can be partially or fully filled by various gases, including but not limited to air, nitrogen, hydrogen, helium, any inert gas, xenon, argon, etc. In one embodiment the gap element 320 can serve to detect leakage of the gas in the gap 203.

Further, an electromagnetic interference (EMI) shielding layer 318 can partially or fully enclose the die 206 and/or the electronic elements 210. In various embodiments, the EMI shielding 318 can partially or fully serve as a reflector (for example, the reflector associated with the Yagi-Uda implementation of the antenna in the electronic device, for example, as described herein).

In one embodiment, the package 205 can have one or more connectors 224. The connector 224 can send and receive information (e.g., data in the form of data packets) from a package containing the die (e.g., RFIC). The connectors 224 can comprise a freestanding element or at least a partially freestanding element that can send and receive communications from the die 206 (optionally in communication with the antenna elements, e.g., feeding elements 214) to the remainder of electronic device (e.g., mobile phone). For example, in an embodiment, the connector 224 can comprise a coax connector. In one embodiment, the coax connector can be at least partially freestanding (e.g., not rigidly mounted to a substrate/PCB). In one embodiment, the connectors 224 can further include a cable (not shown). In another embodiment, the connectors 224 can be at least partially integrated with and be a part of a component (not shown) that can be mounted or otherwise attached to one or more printed circuits boards (PCBs), for example, a motherboard on the electronic device (e.g., a mobile phone).

Figure 4:
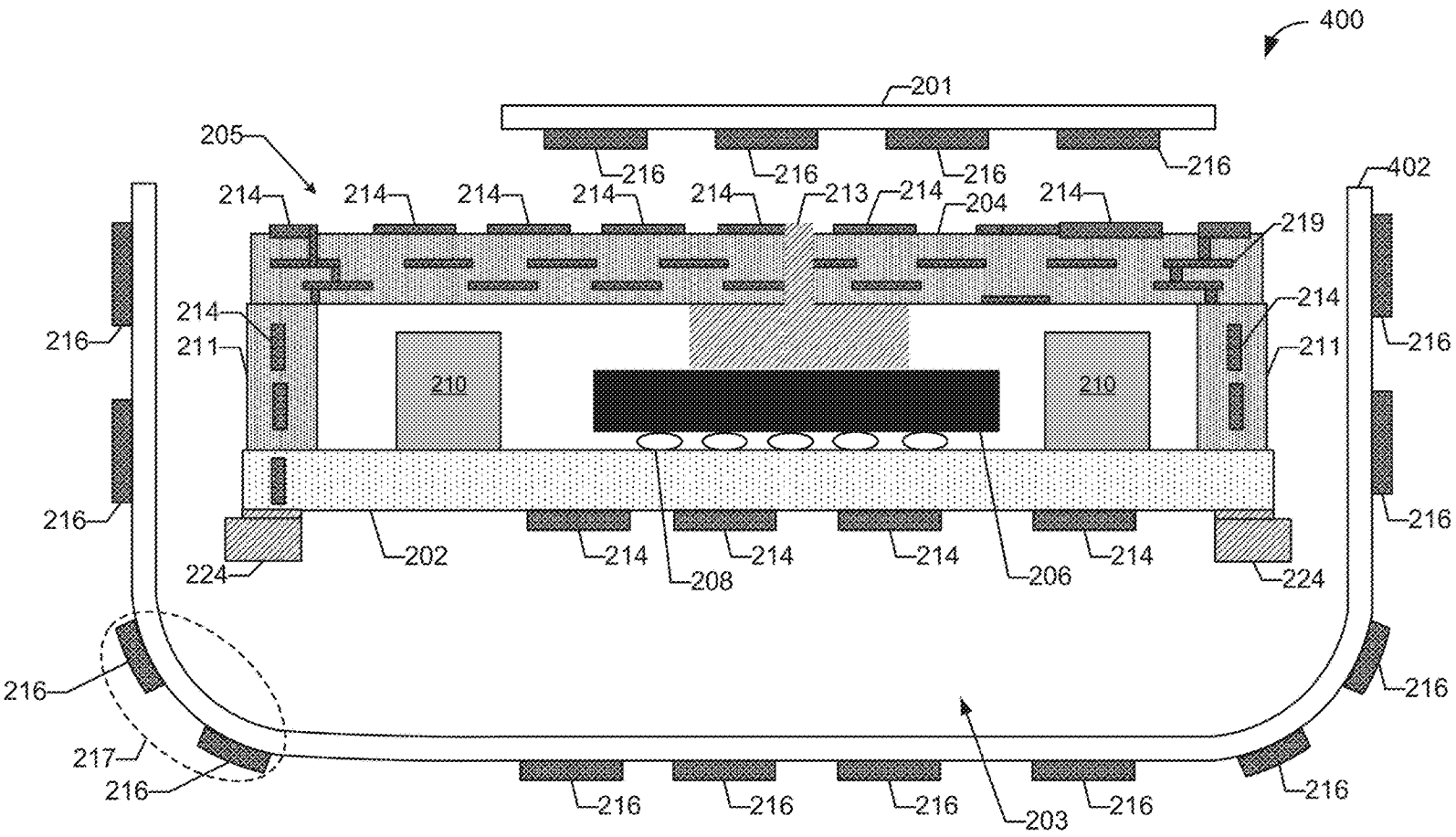
FIG. 4 depicts another simplified diagram depicting a cross-sectional view of a portion of an example electronic device having various antennas elements, in accordance with example embodiments of the disclosure.

FIG. 4 illustrates a simplified cross-sectional view of a portion 400 of an electronic device having an antenna package including the feeding elements and the parasitic elements and portions of the chassis of an electronic device in accordance with one or more embodiments of the disclosure.

The portion 400 includes a first portion of the chassis 201 and a second portion of the chassis 402. In one embodiment, the first portion of the chassis 201 can be physically detachable from the second portion of the chassis 402 of the electronic device 400.

FIG. 4 further illustrates one or more connectors 224. The connectors 224 can comprise any suitable connector, including, but not limited to, a coaxial connector, an AFL connector, an electronic bus, a USB connector, an RF connector, or any other suitable connector. In FIG. 4 two connectors 224 are shown for reference; however, more (or less) than two connectors 224 can be present in order to physically mount and/or support any component of the package including, but not limited to, a substrate 202, a core 204, PCB boards 211 and/or RDL layers 211, feed elements 214, electronic components 210, and/or die 206.

In one example embodiment, the chassis 201 can include at least a portion of a battery that may have a first portion associated with having the parasitic elements 216. Additionally, or alternatively, the first portion of the chassis 201 can include a flexible film and/or a sticker including parasitic elements 216. Further, the chassis 201 can include a plug-in connector and/or a smart connector (see for example, FIGS. 6A and/or 6B and relevant description) or a case that at least partially encloses the device having the parasitic elements. Further, the parasitic elements 216 can be positioned relative to the feeding elements 214 across a gap 203, such that the spacing and alignment between the parasitic elements 216 and feeding elements 214 is controlled and within a predetermined tolerance.

In an example embodiment, the first portion of the chassis 201 can include a design at least partially created by the parasitic elements 216. For instance, the parasitic elements 216 may take the form of the indicia, or alternatively, the parasitic elements 216 may be configured on or embedded in an exposed surface of the chassis 201 to create the indicia.

Figure 5:
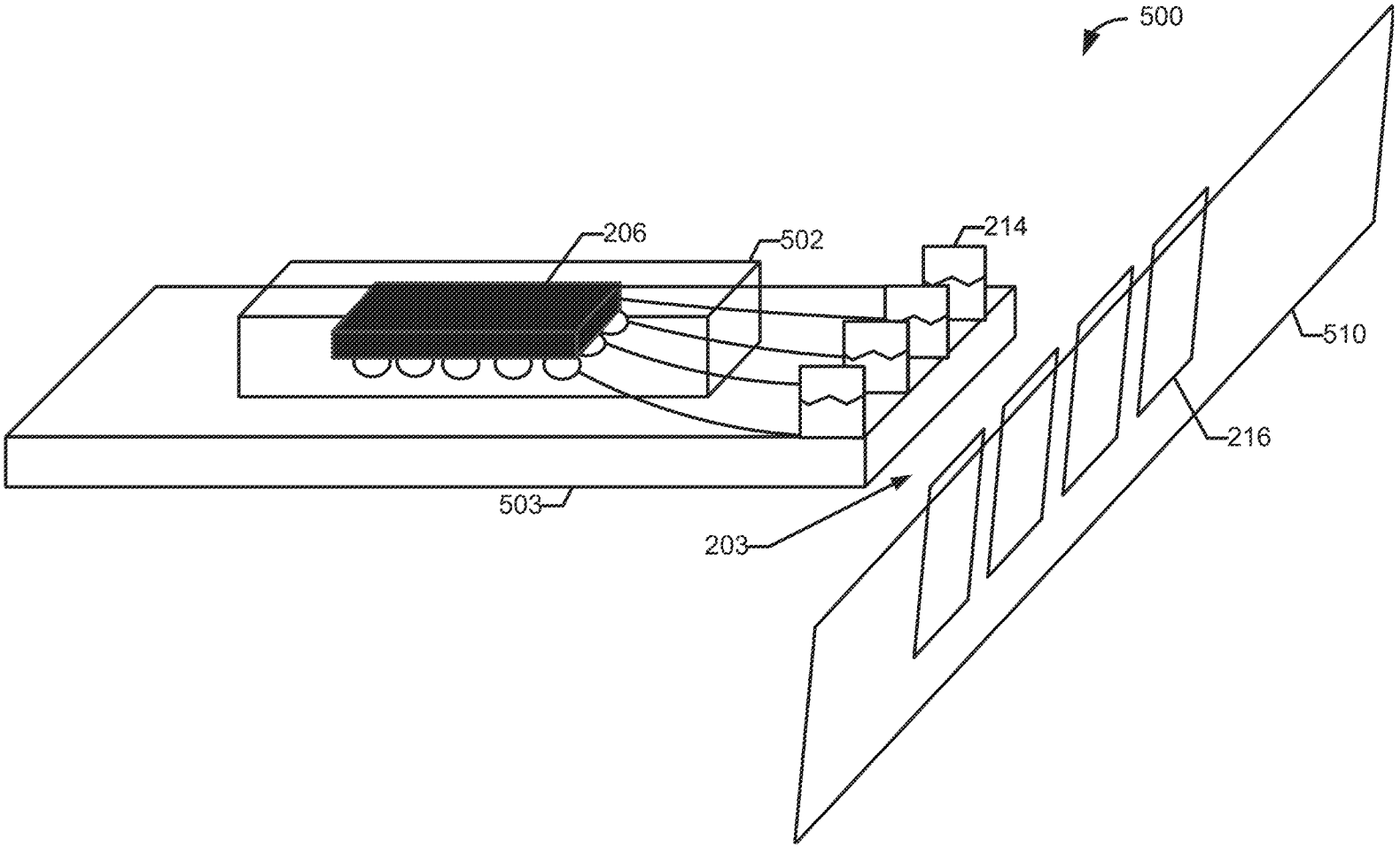
FIG. 5 depicts another simplified diagram depicting a view of a portion of example electronic device having various antennas elements, in accordance with example embodiments of the disclosure.

FIG. 5 illustrates an example configuration 500 of the die, feeding elements and parasitic elements, as may be implemented in connection with an electronic device (such as a cell phone, game device, wireless access point, laptop, tablet, and the like) in accordance with example embodiments of the disclosure. In one embodiment, a die 206 may be affixed, attached, or otherwise mechanically coupled to a substrate 503, and can include any suitable integrated circuit, including, but not limited to, a radiofrequency integrated circuit (RFIC). While only one die 206 is illustrated, it will appreciated that more than one die 206 may be affixed to the substrate 503. The die 206 can be partially or completely encapsulated or covered by, or form a part of, a package 502. The package 502 can include any number of electronic and mechanical elements including but not limited to the various elements discussed herein. In one embodiment, the package 502 can have a Z-height on the order of approximately 1.0 millimeters to approximately 10 millimeters, for example, approximately 0.9 mm to approximately 1.0 mm.

Further, shown in FIG. 5 are feeding elements 214. The feeding elements 214 can be positioned on the substrate 503, and may or may not be directly proximate to the package 502. The feeding element 214 can be in electronic communication with the die 206 using electronic connections, including but not limited to traces, wires, cables, and/or electromagnetic wireless radiation. In one embodiment, the feeding elements 214 can have a Z-height on the order of approximately 1.0 millimeter to approximately 10.0 millimeters, for example, approximately 1.0 mm to approximately 2.0 mm.

In another embodiment (not shown), the feeding elements 214 can form a part of the package 502, and in certain embodiments, may be disposed on or proximate a side of the package 502 (or internal to the package 502), as discussed in examples herein.

Further, in another embodiment, the feeding elements 214 can be a part of the die 206, including but not limited to vias and/or metal traces internal to the die 206, as discussed in examples herein.

FIG. 5 illustrates a structural element 510, which may include a portion of a chassis and/or a peripheral element of an electronic device. The structural element 510 may include, but is not limited to a sticker and/or a flexible film that may be affixed to the chassis of the electronic device, on an internal surface or an external surface thereof. In some embodiments, the structural element 510 may include a portion of a battery or the like associated with the electronic device.

Further, parasitic elements 216 may be disposed, affixed, attached, and/or mechanically coupled to the structural element 510. For example, the parasitic elements 216 may be disposed, affixed, attached, and/or mechanically coupled to the structural element 510 using an epoxy, an adhesive material, a mechanical element (for example, a screw or a bracket), or using any other suitable mechanism. In one embodiment, the parasitic elements 216 can form a spaced relationship to the feeding elements 214, for example, over a gap (similar, but not necessarily identical to, the gap 203 of preceding figures). In one embodiment, a distance (for example, a dimension of the gap) between a given feeding elements 214 and a given parasitic element 216 can be on the order of 1-10 millimeters, for example, approximately 0.5 mm to approximately 1.0 mm.

FIG. 5 does not show connectors such as, for example, the connectors 224 in preceding FIGs. (e.g., FIG. 1-4); however, it can be understood that there may be connectors to attach or provide electrical communication to and from the dies 206 and/or any other shown elements on FIG. 5 or any of the elements disclosed herein.

Figure 6A:
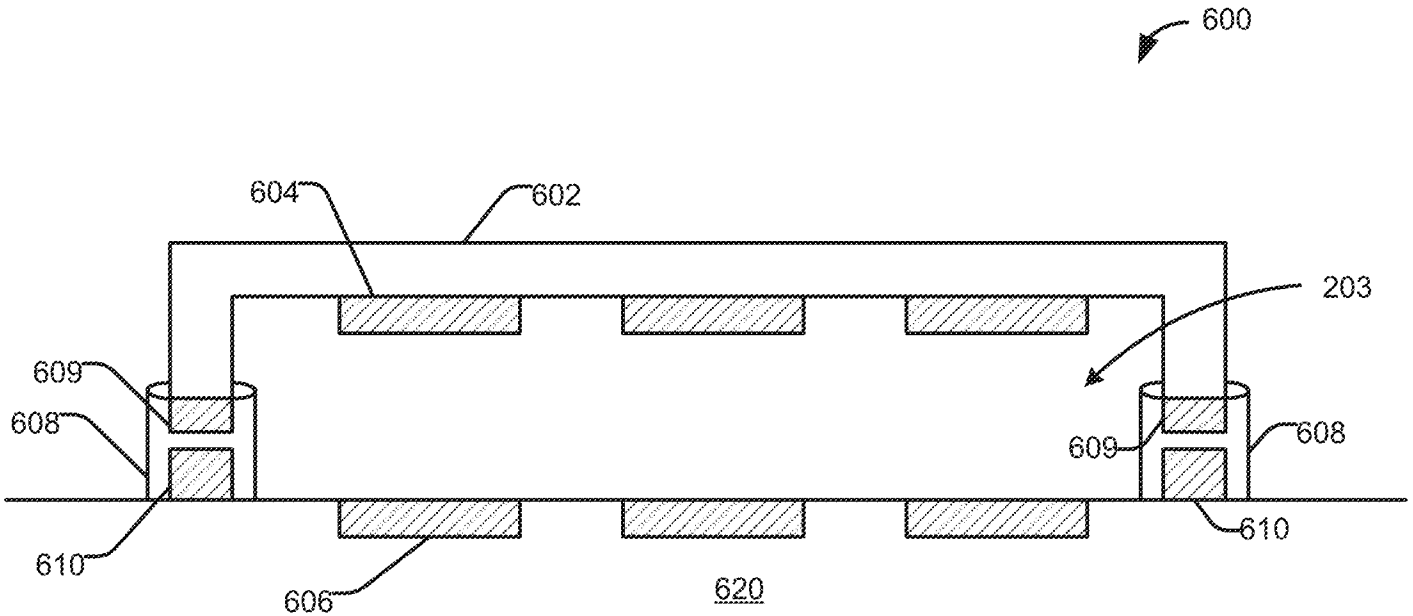
FIG. 6A depicts another simplified diagram depicting a view of a portion of example electronic device having smart connectors and various antennas elements, in accordance with example embodiments of the disclosure.

FIG. 6A illustrates a cross-sectional view of an example embodiment 600 of structural elements that may provide for precise alignment and/or attachment of portions of an electronic device having parasitic elements to another portion of the electronic device having feeding elements, in accordance with one or more embodiments of the disclosure. As shown in, a first portion of the chassis 602 of an electronic device can be provided. The first portion of the chassis 602 can include parasitic elements 604, as disclosed in various embodiments herein. The parasitic elements 604 are disposed on a first surface 605 of the chassis 602, though the parasitic elements 606 may be disposed on or embedded in, or at least partially in, any of the surfaces the chassis 602, and/or a combination of surfaces.

In one embodiment, the first portion of the chassis 602 can be disposed proximate to a package 620, which may include feeding elements 606, as well as PCB's, substrate, etc., thereby defining a gap 203 that may be filled with air, gas, or fluid as discussed above. In one embodiment, the first portion of the chassis 602 can be connected to the portion of the package 620 using smart connectors 608. These smart connectors 608 can include, for example, magnetic elements, including a first magnet element 609 and a corresponding second magnet element 610. These magnet elements 609, 610 may attract one another to both secure and align the chassis 602 and the package 620 with one another. Additionally, and/or alternatively, there may be a mechanical alignment mechanism, such as a detent positioned on one or more locations about the chassis 602 to bias the chassis 602 to a predetermined position relative to the package 620. By maintaining the relative positioning an alignment of the chassis 602 and the package 620, a desired radiation pattern may be achieved between the feeding elements 606 and the parasitic elements 604. In one embodiment, a tolerance associated with the misalignment in one or more of the X, Y, or Z plane between the feeding element 606 and the parasitic element 604, may be maintained at a predetermined threshold, for example, a threshold on the order of approximately ±5% to approximately ±50% with preferable ranges approximately ±10% to approximately ±20%.

In one embodiment, the smart connector 608 having the magnetic element 609 and the second magnetic element 610 can serve to align and realign the first antenna elements/feeding elements 606 and the second antenna elements/parasitic elements 604. The smart connectors 608 may operate to eliminate or minimize potential misalignment cause by jostling and/or an accident associated with the electronic device that, may otherwise move the parasitic element 604 out of alignment with the feeding element 606. With the smart connectors 608, the first magnet 609 and the second magnet 610 can realign themselves (for example, with reference to a central axis, not shown). In another embodiment (not shown), the feeding elements 606 and the parasitic elements 604 may be mounted or affixed to another substrate or package of the electronic device (not shown).

Figure 6B:
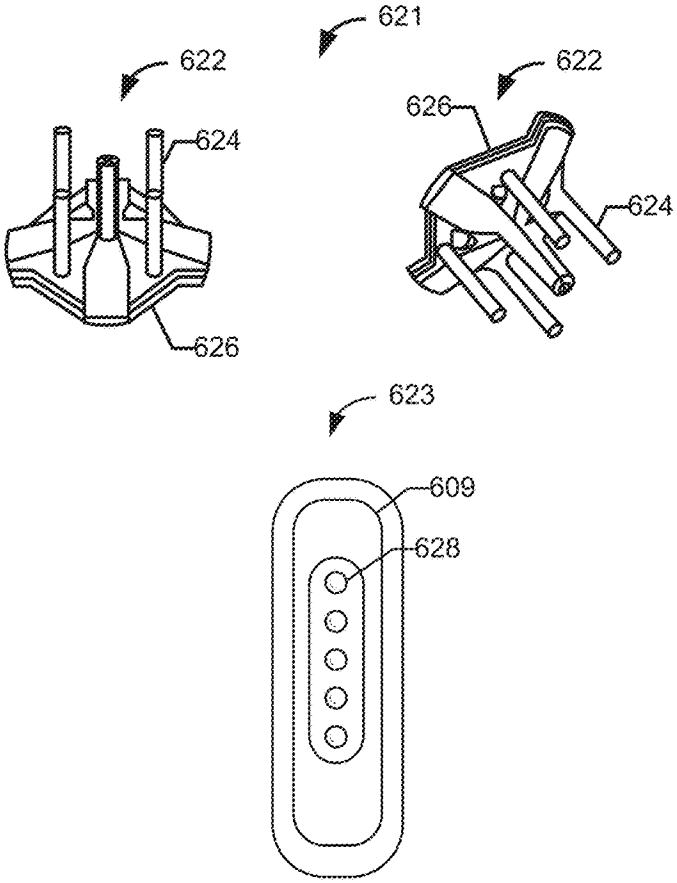
FIG. 6B depicts another simplified diagram depicting one or more connectors, in accordance with example embodiments of the disclosure.

FIG. 6B further illustrates an example of one or more connectors 621 and 623 that may be used in association with the feeding and director antenna elements described herein, in accordance with one or more embodiments of the disclosure. As can be seen in diagrams of the connectors 621 and 623, a mounting element 622 can include support structures 624, which may provide additional displacement (e.g., Z-height) to an antenna mounted on one face 626 of the mounting element 622. For example, second antenna elements (not shown) can be mounted on the face of the mounting element 622, and the support structure 624 can be used to effectively suspend the parasitic elements (not shown) in a gap (not shown) (for example, similar to the gap 206 of FIGS. 1 through 6A). FIG. 6B further illustrates another example mounting element 623, including antenna elements 628 that may be proximate to one face of the mounting element 623. The mounting element may further contain magnets (similar to the magnets 608 and/or 609 of FIG. 6A) in order to self-align and/or realign with a corresponding structure containing feed elements (not shown) which may be mounted on a substrate and/or any other portion of the internal parts of the electronic device.

Figure 7:
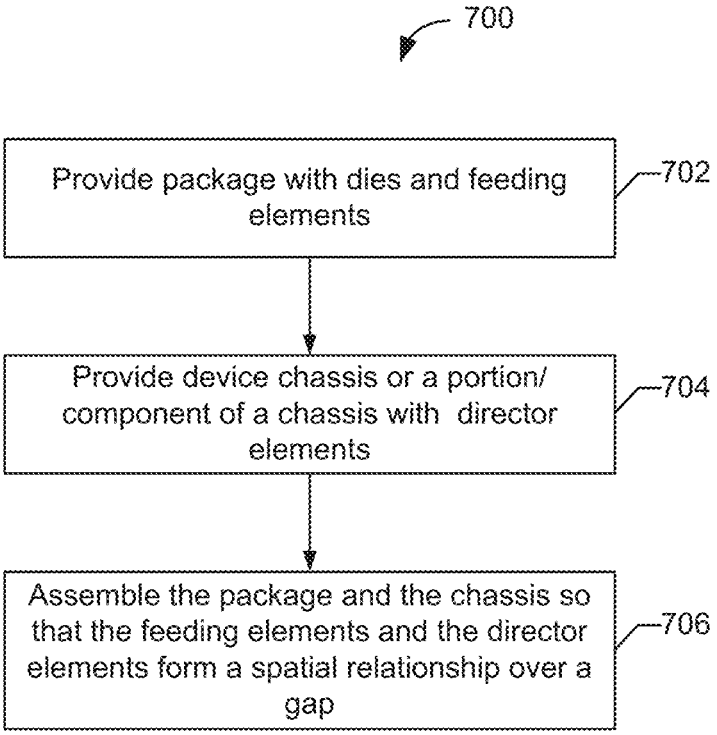
FIG. 7 depicts a diagram of an example flow for assembly of a portable electronic device having antenna elements in accordance with one or more embodiments of the disclosure.

FIG. 7 illustrates a diagram 700 of an example flow for providing the feeding elements and the parasitic elements on portions of the electronic device, housing, and/or chassis of an electronic device in accordance with one or more embodiments of the disclosure. In block 702, a package with dies and feeding elements can be provided. In block 704, a chassis and/or a portion/component of a chassis associated with an electronic device having parasitic elements can be provided. In block 706, the package and the chassis (or portion/component of the chassis) can be assembled so that the feeding elements and the parasitic elements form a spatial relationship over a gap (e.g., an air gap).

In one embodiment, at least one portion of a package (e.g., similar, but not necessarily identical to the package 205 of FIG. 2B) can be provided at an intermediate manufacturing step. Next, a feeding element may be fabricated directly or indirectly on a substrate (e.g., a PCB) to which the package or portion of the package is to be attached or affixed. In addition, the supporting reference designs and/or fiducial marks may also be provided on the substrate. In one embodiment, the reference design can be used to fabricate feeds (e.g., transmission lines) that can electronically couple the feeding elements associated with the provided package. The feeding elements can be implemented as surface mount components and/or screws and/or needles, as discussed herein. Alternatively or additionally, copper and/or other features like printed dipoles, monopoles, a planar inverted f (PIFA) design, fractal design, and/or patches, and/or any other suitable component may be implemented, as may be appropriate for the subject antenna design.

In one embodiment, a self-contained element, for example, a die can be provided, for example, in the form of a surface mount component. Electrical connectivity can be implemented on the die, for example, in the form of feeds (e.g., transmission lines and/or matching lines) to the die (e.g., a surface mount silicon package or a silicon die). In one embodiment, the electrical connectivity can further comprise a feed element to feed the self-contained element with signals to transmit via the antenna(s). In one embodiment, the die (e.g., a surface mount silicon package or a silicon die) can be at least spatially aligned to elements (e.g., feeding elements, parasitic elements, and/or other elements disclosed herein) in a second portion of an electronic device (for example, the substrates associated with and/or the housing/chassis of a mobile phone).

Figure 8:
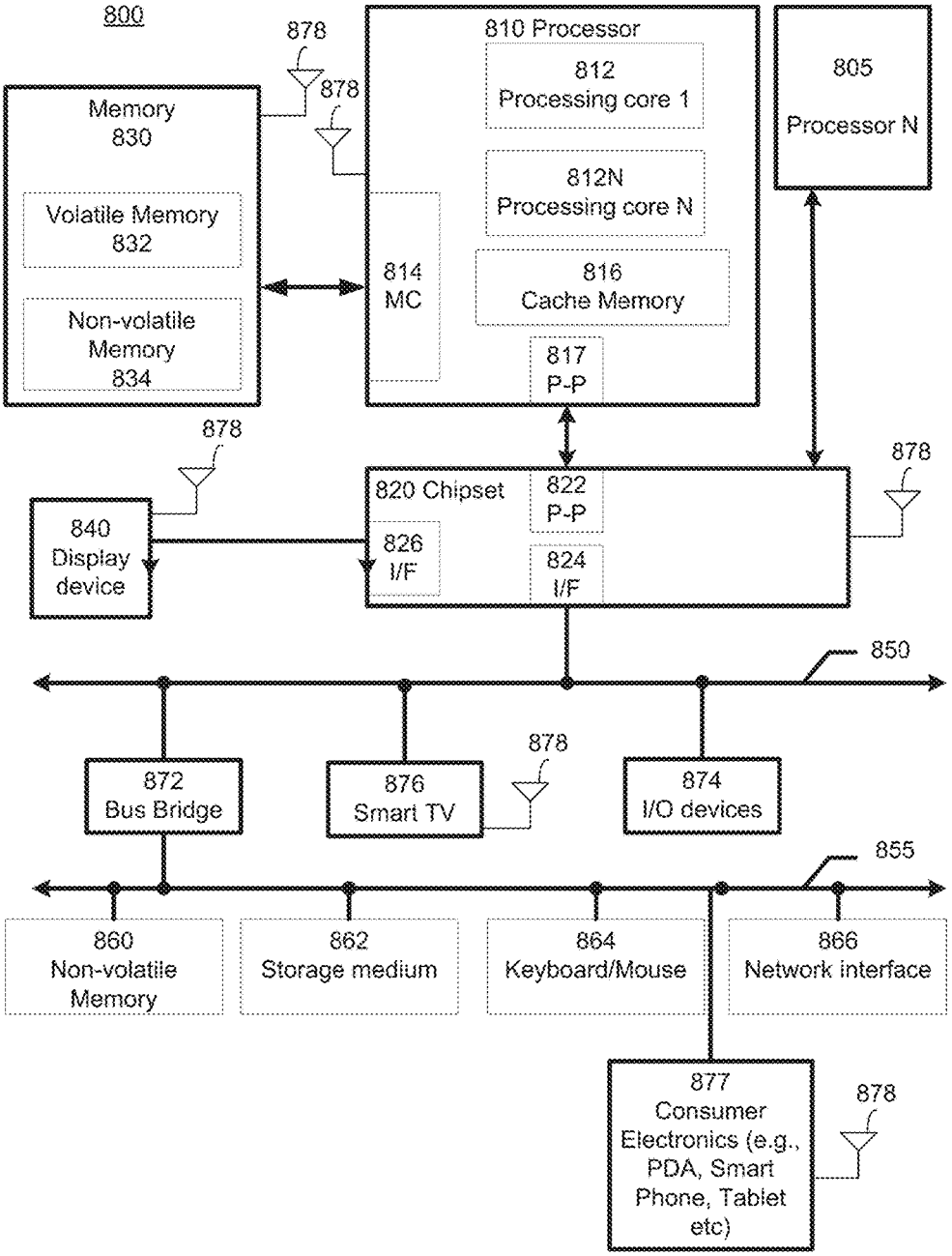
FIG. 8 depicts a system level diagram in accordance with example embodiments of the disclosure.

FIG. 8 illustrates a system level diagram, according to one embodiment of the disclosure. In one embodiment, system 800 includes, but is not limited to, a desktop computer, a laptop computer, a netbook, a tablet, a notebook computer, a personal digital assistant (PDA), a server, a workstation, a cellular telephone, a mobile computing device, a smart phone, an Internet appliance or any other type of computing device. In some embodiments, system 800 can include a system on a chip (SOC) system.

In one embodiment, processor 810 has one or more processing cores 812 and 812N, where 812N represents the Nth processor core inside processor 810, where N is a positive integer.

In one embodiment, system 800 includes multiple processors including 810 and 805, where processor 805 has logic similar or identical to the logic of processor 810. In some embodiments, processing core 812 includes, but is not limited to, pre-fetch logic to fetch instructions, decode logic to decode the instructions, execution logic to execute instructions and the like. In some embodiments, processor 810 has a cache memory 816 to cache instructions and/or data for system 800. Cache memory 816 may be organized into a hierarchal structure including one or more levels of cache memory.

In some embodiments, processor 810 includes a memory controller 814, which is operable to perform functions that enable the processor 810 to access and communicate with memory 830 that includes a volatile memory 832 and/or a non-volatile memory 834. In some embodiments, processor 810 is coupled with memory 830 and chipset 820. Processor 810 may also be coupled to a wireless antenna 878 to communicate with any device configured to transmit and/or receive wireless signals. In one embodiment, the wireless antenna interface 878 operates in accordance with, but is not limited to, the IEEE 802.11 standard and its related family, Home Plug AV (HPAV), Ultra Wide Band (UWB), Bluetooth, WiMax, or any form of wireless communication protocol.

In some embodiments, volatile memory 832 includes, but is not limited to, Synchronous Dynamic Random Access Memory (SDRAM), Dynamic Random Access Memory (DRAM), RAMBUS Dynamic Random Access Memory (RDRAM), and/or any other type of random access memory device. Non-volatile memory 834 includes, but is not limited to, flash memory, phase change memory (PCM), read-only memory (ROM), electrically erasable programmable read-only memory (EEPROM), or any other type of non-volatile memory device.

Memory 830 stores information and instructions to be executed by processor 810. In one embodiment, memory 830 may also store temporary variables or other intermediate information while processor 810 is executing instructions. In the illustrated embodiment, chipset 820 connects with processor 10 via Point-to-Point (PtP or P-P) interfaces 817 and 822. Chipset 820 enables processor 810 to connect to other elements in system 800. In some embodiments of the disclosure, interfaces 817 and 822 operate in accordance with a PtP communication protocol such as the Intel® QuickPath Interconnect (QPI) or the like. In other embodiments, a different interconnect may be used.

In some embodiments, chipset 820 is operable to communicate with processor 810, 805N, display device 840, and other devices 872, 876, 874, 860, 862, 864, 866, 877, etc. Chipset 820 may also be coupled to a wireless antenna 878 to communicate with any device configured to transmit and/or receive wireless signals.

Chipset 820 connects to display device 340 via interface 826. Display 840 may be, for example, a liquid crystal display (LCD), a plasma display, cathode ray tube (CRT) display, or any other form of visual display device. In some embodiments of the disclosure, processor 810 and chipset 820 are merged into a single SOC. In addition, chipset 820 connects to one or more buses 850 and 855 that interconnect various elements 874, 860, 862, 864, and 866. Buses 850 and 855 may be interconnected together via a bus bridge 872. In one embodiment, chipset 820 couples with a non-volatile memory 860, a mass storage device(s) 862, a keyboard/mouse 864, and a network interface 866 via interface 824 and/or 804, smart TV 876, consumer electronics 877, etc.

It will be appreciated that the apparatus described herein may be any suitable type of microelectronics packaging and configurations thereof, including, for example, system in a package (SiP), system on a package (SOP), package on package (PoP), interposer package, 3D stacked package, etc. In fact, any suitable type of microelectronic components may be provided in the semiconductor packages, as described herein. For example, microcontrollers, microprocessors, baseband processors, digital signal processors, memory dies, field gate arrays, logic gate dies, passive component dies, MEMSs, surface mount devices, application specific integrated circuits, baseband processors, amplifiers, filters, combinations thereof, or the like may be packaged in the semiconductor packages, as disclosed herein. The semiconductor packages, as disclosed herein, may be provided in any variety of electronic device including consumer, industrial, military, communications, infrastructural, and/or other electronic devices.

The semiconductor package, as described herein, may be used to house one or more processors. The one or more processors may include, without limitation, a central processing unit (CPU), a digital signal processor(s) (DSP), a reduced instruction set computer (RISC), a complex instruction set computer (CISC), a microprocessor, a microcontroller, a field programmable gate array (FPGA), or any combination thereof. The processors may also include one or more application specific integrated circuits (ASICs) or application specific standard products (ASSPs) for handling specific data processing functions or tasks. In certain embodiments, the processors may be based on an Intel® Architecture system and the one or more processors and any chipset included in an electronic device may be from a family of Intel® processors and chipsets, such as the Intel® Atom® processor(s) family or Intel-64 processors (e.g., Sandy Bridge®, Ivy Bridge®, Haswell®, Broadwell®, Skylake®, etc.).

Additionally or alternatively, the semiconductor package, as described herein, may be used to house one or more memory chips. The memory may include one or more volatile and/or non-volatile memory devices including, but not limited to, magnetic storage devices, read-only memory (ROM), random access memory (RAM), dynamic RAM (DRAM), static RAM (SRAM), synchronous dynamic RAM (SDRAM), double data rate (DDR) SDRAM (DDR-SDRAM), RAM-BUS DRAM (RDRAM), flash memory devices, electrically erasable programmable read-only memory (EEPROM), non-volatile RAM (NVRAM), universal serial bus (USB) removable memory, or combinations thereof.

In example embodiments, the electronic device in which the semiconductor package is provided may be a computing device. Such a computing device may house one or more boards on which the semiconductor package connections may be disposed. The board may include a number of components including, but not limited to, a processor and/or at least one communication chip. The processor may be physically and electrically connected to the board through, for example, electrical connections of the semiconductor package. The computing device may further include a plurality of communication chips. For instance, a first communication chip may be dedicated to shorter range wireless communications such as Wi-Fi and Bluetooth, and a second communication chip may be dedicated to longer range wireless communications such as GPS, EDGE, GPRS, CDMA, WiMAX, LTE, EV-DO, and others. In various embodiments, the computing device may be a laptop, a netbook, a notebook, an ultrabook, a smartphone, a tablet, a personal digital assistant (PDA), an ultra-mobile PC, a mobile phone, a desktop computer, a server, a printer, a scanner, a monitor, a set-top box, an entertainment control unit, a digital camera, a portable music player, a digital video recorder, combinations thereof, or the like. In further example embodiments, the computing device may be any other electronic device that processes data.

In an embodiment, an electronic device is described. The electronic device can include: a substrate including a die and an antenna feeding element having a wired connection to the die; and a chassis component including an antenna parasitic element. In one embodiment, the chassis component may be disposed substantially proximate to the substrate to align the antenna parasitic element in a spaced relationship with the antenna feeding element. In another embodiment, the antenna feeding element and the antenna parasitic element at least partially define a gap therebetween.

In one embodiment, the antenna feeding element may be integral to the die. In one embodiment, the electronic device further includes an alignment element, wherein the antenna feeding element and the antenna parasitic element are positioned relative to one another using the alignment element. In one embodiment, the antenna feeding element and the antenna parasitic element form at least a portion of a Yagi-Uda antenna. In one embodiment, the antenna feeding element and the antenna parasitic element form at least a portion of a millimeter wave antenna. In one embodiment, the chassis component includes a cover associated with the electronic device.

In one embodiment, the chassis component further includes one or more of an adhesive film or an epoxy. In another embodiment, the antenna parasitic element can be mechanically coupled to the chassis component by the one or more of the adhesive film or the epoxy. In one embodiment, the gap can be filled with one or more of a gas, a gap element, a liquid, or a dielectric material. In one embodiment, the antenna feeding element or the antenna parasitic element includes one or more of a patch antenna, a spiral antenna, a monopole antenna, a dipole antenna, a planar inverted f antenna (PIFA), and/or a fractal antenna.

In one embodiment, the electronic device further includes a reflector that directs radiation emitted by the antenna feeding element or antenna parasitic element. In one embodiment, at least a portion of the antenna parasitic element can be integrated in the chassis component. In one embodiment, at least a portion of the antenna feeding element or the antenna parasitic element includes a high dielectric constant material.

In an embodiment, a mobile electronic device is described. The mobile electronic device can include: a display device; a housing member coupled to the display device, the housing member including circuitry including computing components and storage components, a portion of the circuitry coupled to the display device; and a substrate including a die and an antenna feeding element, the antenna feeding element having a wired connection to the die; and a chassis component including an antenna parasitic element. In one embodiment, the chassis component can be coupled to the substrate and disposed proximate to the substrate to align the antenna parasitic element with the antenna feeding element. In another embodiment, the antenna feeding element and the antenna parasitic element can at least partially define a gap therebetween.

In one embodiment, the antenna parasitic element can be electrically coupled to the antenna feeding element over the gap. In one embodiment, the antenna feeding element can be integral to the die. In one embodiment, the mobile electronic device can include a reflector to direct radiation emitted by the feeding antenna element or antenna parasitic element. In one embodiment, the mobile electronic device can include an alignment element. In another embodiment, one or more of the antenna feeding element and the antenna parasitic element can be positioned using the alignment element.

In one embodiment, the antenna feeding element and the antenna parasitic element can form at least a portion of a Yagi-Uda antenna. In one embodiment, the antenna feeding element and/or the antenna parasitic element can form at least a portion of a millimeter wave antenna.

In an embodiment a method is described. The method can include: providing a substrate including a die and an antenna feeding element, the antenna feeding element having a wired connection to the die; providing a chassis component including an antenna parasitic element; and assembling the substrate and the chassis component such that the chassis component can be disposed substantially proximate to the substrate.

In one embodiment, the method can include assembling the substrate and the chassis component such that the antenna parasitic element forms a spaced relationship with the antenna feeding element and the antenna feeding element and the antenna parasitic element at least partially define an gap there between. In another embodiment, the method can include providing one or more of an adhesive film or an epoxy on the chassis component whereby the antenna parasitic element can be mechanically coupled to the chassis component by the one or more of the adhesive film or the epoxy.

In an embodiment, an apparatus is described. The apparatus can include: means for providing a substrate including a die and an antenna feeding element, the antenna feeding element having a wired connection to the die; means for providing a chassis component including an antenna parasitic element; and means for assembling the substrate and the chassis component such that the chassis component can be disposed substantially proximate to the substrate.

In one embodiment, the apparatus can include means for assembling the substrate and the chassis component such that the antenna parasitic element forms a spaced relationship with the antenna feeding element and the antenna feeding element and the antenna parasitic element at least partially define an gap there between. In one embodiment, the apparatus can include means for providing one or more of an adhesive film or an epoxy on the chassis component whereby the antenna parasitic element can be mechanically coupled to the chassis component by the one or more of the adhesive film or the epoxy.

Various features, aspects, and embodiments have been described herein. The features, aspects, and embodiments are susceptible to combination with one another as well as to variation and modification, as will be understood by those having skill in the art. The present disclosure should, therefore, be considered to encompass such combinations, variations, and modifications.

The terms and expressions which have been employed herein are used as terms of description and not of limitation, and there is no intention, in the use of such terms and expressions, of excluding any equivalents of the features shown and described (or portions thereof), and it is recognized that various modifications are possible within the scope of the claims. Other modifications, variations, and alternatives are also possible. Accordingly, the claims are intended to cover all such equivalents.

While the disclosure includes various embodiments, including at least a best mode, it is to be understood that many alternatives, modifications, and variations will be apparent to those skilled in the art in light of the foregoing description. Accordingly, the disclosure is intended to embrace all such alternatives, modifications, and variations, which fall within the scope of the included claims. All matters disclosed herein or shown in the accompanying drawings are to be interpreted in an illustrative and non-limiting sense.

This written description uses examples to disclose certain embodiments of the disclosure, including the best mode, and also to enable any person skilled in the art to practice certain embodiments of the disclosure, including making and using any apparatus, devices or systems and performing any incorporated methods and processes. The patentable scope of certain embodiments of the invention is defined in the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The claimed invention is:

1. An electronic device comprising:

a substrate including a die and an antenna feeding element having a wired connection to the die;

a chassis component comprising an antenna parasitic element, the chassis component disposed substantially proximate to the substrate to align the antenna parasitic element in a spaced relationship with the antenna feeding element, the antenna feeding element and the antenna parasitic element at least partially define a gap therebetween; and an alignment element that detects misalignment between the antenna feeding element and the antenna parasitic element, the alignment element at least partially in the gap.

2. The electronic device of claim 1, wherein the antenna feeding element is integral to the die.

3. The electronic device of claim 1, wherein the antenna feeding element and the antenna parasitic element form at least a portion of a Yagi-Uda antenna.

4. The electronic device of claim 1 wherein the antenna feeding element and the antenna parasitic element form at least a portion of a millimeter wave antenna.

5. The electronic device of claim 1, wherein the chassis component comprises a cover associated with the electronic device.

6. The electronic device of claim 1, wherein the chassis component further comprises one or more of an adhesive film or an epoxy, whereby the antenna parasitic element is mechanically coupled to the chassis component by the one or more of the adhesive film or the epoxy.

7. The electronic device of claim 1, wherein the gap is filled with one or more of a gas, a liquid, or a dielectric material.

8. The electronic device of claim 1, wherein the antenna feeding element or the antenna parasitic element comprises one or more of a patch antenna, a spiral antenna, a monopole antenna, a dipole antenna, a planar inverted f antenna (PIFA), or a fractal antenna.

9. The electronic device of claim 1, further comprising a reflector that directs radiation emitted by the antenna feeding element or antenna parasitic element.

10. The electronic device of claim 1, wherein at least a portion of the antenna parasitic element is integrated in the chassis component.

11. The electronic device of claim 1 wherein at least a portion of the antenna feeding element or the antenna parasitic element comprises a high dielectric constant material.

12. A mobile electronic device comprising:

a display device; and a housing member coupled to the display device, the housing member comprising:

circuitry comprising computing components and storage components, a portion of the circuitry coupled to the display device;

a substrate including a die and an antenna feeding element, the antenna feeding element having a wired connection to the die;

a chassis component comprising an antenna parasitic element, the chassis component coupled to the substrate and disposed proximate to the substrate to align the antenna parasitic element with the antenna feeding element, wherein the antenna feeding element and the antenna parasitic element at least partially define a gap therebetween; and an alignment element that detects misalignment between the antenna feeding element and the antenna parasitic element, the alignment element at least partially in the gap.

13. The mobile electronic device of claim 12 wherein the antenna parasitic element is electrically coupled to the antenna feeding element over the gap.

14. The mobile electronic device of claim 12 wherein the antenna feeding element is integral to the die.

15. The mobile electronic device of claim 12 further comprising a reflector to direct radiation emitted by the feeding antenna element or antenna parasitic element.

16. The mobile electronic device of claim 12 wherein one or more of the antenna feeding element and the antenna parasitic element form at least a portion of a Yagi-Uda antenna.

17. The mobile electronic device of claim 12 wherein one or more of the antenna feeding element and the antenna parasitic element form at least a portion of a millimeter wave antenna.

18. A method comprising:

providing a substrate including a die and an antenna feeding element, the antenna feeding element having a wired connection to the die;

providing a chassis component including an antenna parasitic element;

assembling the substrate and the chassis component such that the chassis component is disposed substantially proximate to the substrate and the antenna parasitic element is aligned in a spaced relationship with the antenna feeding element, the antenna feeding element and the antenna parasitic element at least partially defining a gap therebetween; and providing an alignment element that detects misalignment between the antenna feeding element and the antenna parasitic element, the alignment element at least partially in the gap.

19. The method of claim 18 further comprising providing one or more of an adhesive film or an epoxy on the chassis component whereby the antenna parasitic element is mechanically coupled to the chassis component by the one or more of the adhesive film or the epoxy.

* * * * *